US008229143B2

(12) United States Patent
Bharitkar et al.

(10) Patent No.: US 8,229,143 B2
(45) Date of Patent: Jul. 24, 2012

(54) STEREO EXPANSION WITH BINAURAL MODELING

(76) Inventors: Sunil Bharitkar, Los Angeles, CA (US); Chris Kyriakakis, Altadena, CA (US)

( * ) Notice: Subject to any disclaimer, the term of this patent is extended or adjusted under 35 U.S.C. 154(b) by 1113 days.

(21) Appl. No.: 12/116,913

(22) Filed: May 7, 2008

(65) Prior Publication Data

US 2008/0279401 A1 Nov. 13, 2008

Related U.S. Application Data

(60) Provisional application No. 60/928,206, filed on May 7, 2007.

(51) Int. Cl.
*H04R 5/02* (2006.01)
*H04R 5/00* (2006.01)

(52) U.S. Cl. ..... 381/300; 381/1; 381/17; 381/18; 381/27; 381/310

(58) Field of Classification Search ..... 381/300, 381/1, 17, 18, 310
See application file for complete search history.

(56) References Cited

U.S. PATENT DOCUMENTS 3,970,787 A * 7/1976 Searle ..... 381/310
4,495,637 A * 1/1985 Bruney ..... 381/1
5,325,436 A * 6/1994 Soli et al. ..... 381/313
5,799,094 A * 8/1998 Mouri ..... 381/18
5,943,427 A * 8/1999 Massie et al. ..... 381/17
6,449,368 B1 * 9/2002 Davis et al. ..... 381/1
6,577,736 B1 * 6/2003 Clemow ..... 381/18
7,197,151 B1 * 3/2007 Sibbald et al. ..... 381/310
2002/0006206 A1 * 1/2002 Scofield ..... 381/27
2002/0196947 A1 * 12/2002 Lapicque ..... 381/17
2003/0031333 A1 * 2/2003 Cohen et al. ..... 381/303
2003/0142830 A1 * 7/2003 Rishoj ..... 381/27
2004/0013271 A1 * 1/2004 Moorthy ..... 381/1
2004/0076301 A1 * 4/2004 Algazi et al. ..... 381/17
2004/0170281 A1 * 9/2004 Nelson et al. ..... 381/17
2004/0179693 A1 * 9/2004 Abel ..... 381/1
2005/0265558 A1 * 12/2005 Neoran ..... 381/17
2006/0045294 A1 * 3/2006 Smyth ..... 381/309
2006/0056646 A1 * 3/2006 Bharitkar et al. ..... 381/98
2006/0280323 A1 * 12/2006 Neidich et al. ..... 381/300
2007/0009120 A1 * 1/2007 Algazi et al. ..... 381/310
2007/0274527 A1 * 11/2007 Abel ..... 381/1
2008/0025534 A1 * 1/2008 Kuhn et al. ..... 381/300
2008/0056503 A1 * 3/2008 McGrath ..... 381/17
2008/0056517 A1 * 3/2008 Algazi et al. ..... 381/310
2008/0159544 A1 * 7/2008 Kim ..... 381/1
2008/0273708 A1 * 11/2008 Sandgren et al. ..... 381/63
2008/0298610 A1 * 12/2008 Virolainen et al. ..... 381/307
2010/0312308 A1 * 12/2010 Busby ..... 607/57

* cited by examiner

*Primary Examiner* — Elvin G Enad
*Assistant Examiner* — Christina Russell
(74) *Attorney, Agent, or Firm* — Kenneth L. Green

(57) ABSTRACT

A method for stereo expansion includes a step to remove the effects of actual relative speaker to listener positioning and head shadow and a step to introduce an artificial effect based on a desired virtual relative speaker to listener positioning using the inter-aural delay and the head-shadow models for the virtual speakers at desired angles relative to the listener thereby creating the impression of a widened and centered sound stage and an immersive listening experience. Known methods drown out vocals and add mid-range coloration thereby defeating equalization. The present method includes the integration of a novel binaural listening model and speaker-room equalization techniques to provide widening while not defeating equalization.

9 Claims, 10 Drawing Sheets

STEREO EXPANSION WITH BINAURAL MODELING

The present application claims the priority of U.S. Provisional Patent Application Ser. No. 60/928,206 filed 7 May, 2007, which application is incorporated in its entirety herein by reference.

BACKGROUND OF THE INVENTION

The present invention relates to stereo signal processing and in particular to processing a stereo signal to create the impression of a wide sound stage and/or of immersion.

Conventional stereo reproduction, for example television, two-channel speakers such as iPod® speakers, etc., create an impression of a narrow spatial image. The narrow imaging is primarily due to loudspeaker proximity relative to each other and unmatched speaker-room frequency responses. The goal of any multichannel system is to give the listener an immersive or a "listener-is-there" impression. Unfortunately, narrow stereo imaging precludes such an experience.

The spatial resolution (i.e., localization ability) of human hearing is at least one degree. It is desirable to manipulate stereo signals to enlarge the stereo sound field and imagery by combining concepts from physical acoustics (for example, room acoustics of the space the listener is located in), signal processing (for example, digital filtering), and auditory perception (for example, spatial localization cues). Stereo expansion will allow listeners to perceive audio signals arriving from a wider speaker separation with high-fidelity through the use of a unique binaural listening model and speaker-room equalization technique.

Known stereo signal combining approach (for example, $L+\alpha(L-R)$ and $R+\alpha(R-L)$) have attempted to expand the acoustic field. Unfortunately, these often result in vocals "drowned out" & midrange coloration. Also, benefits from speaker-room equalization cannot be incorporated because the stereo signal combining is independent of room equalization. Other methods include Head-Related-Transfer-Functions (HRTFs) premised on the localization ability of the human pinna (the visible portion of the ear extending from the side of the head which colors sound based on the arrival angle). However, human pinna vary among listeners and an expansion approach, involving use of specific direction HRTF, is not robust, and equalization is again defeated.

BRIEF SUMMARY OF THE INVENTION

The present invention addresses the above and other needs by providing a method for stereo expansion which includes a step to remove the effects of actual relative speaker to listener positioning and head shadow and a step to introduce an artificial effect based on a desired virtual relative speaker to listener positioning using the inter-aural delay and the head-shadow models for the virtual speakers at desired angles relative to the listener thereby creating the impression of a widened and centered sound stage and an immersive listening experience. Known methods drown out vocals and add mid-range coloration thereby defeating equalization. The present method includes the integration of a novel binaural listening model and speaker-room equalization techniques to provide widening while not defeating equalization.

In accordance with one aspect of the invention, there is provided a method including determining speaker angles alpha and beta relative to a listener position wherein said speaker angles are computed using actual stereo speaker spacing and actual listener position, determining actual inter-aural delays between the speakers and the listeners ears, determining the headshadow responses associated with each ear relative to each of the speakers given the speaker angles equalizing the headshadow responses between the speakers and the listener ears, determining virtual speaker angles alpha' and beta' relative to listener position, determining virtual inter-aural delays between the speakers and the listeners ears for virtual speaker angles alpha' and beta', determining virtual headshadow responses associated with each ear relative to each of the virtual speakers given the virtual speaker angles, determining stereo expansion filters from the headshadow responses and the virtual headshadow responses, converting lattice form filters to shuffler form filters, variable octave complex smoothing the shuffler filters, and converting smoothed shuffler filters to smoothed lattice filters for performing spatialization and preserving the audio quality.

In accordance with another aspect of the invention, there is provided a method including (a) determining actual speaker angles alpha and beta relative to listener position centered on the actual speakers wherein said speaker angles are computed using actual stereo speaker spacing and listener position, (b) determining actual inter-aural delays between the speakers and the listener ears, (c) determining the actual headshadow responses associated with each ear relative to each of the speakers given the speaker angles, (d) determining an actual speaker to listener 2×2 matrix transfer function H using the actual inter-aural delays and the actual headshadow responses, (f) determining virtual speaker angles alpha' and beta' relative to listener position wherein said virtual speaker angles are computed using a virtual stereo speaker spacing and listener position, (g) determining virtual inter-aural delays between the virtual speakers and the listeners ears for virtual speaker angles alpha' and beta' relative to listener position, (h) determining virtual headshadow responses associated with each ear relative to each of the virtual speakers given the virtual speaker angles and, (i) determining a virtual speaker to listener 2×2 matrix transfer function $H_{desired}$ representing the transfer functions between the virtual speakers and the listener ears, (j) selecting on-diagonal elements of $H^{-1}\ H_{desired}$ as a pair of ipsilateral filters and selecting off-diagonal elements of $H^{-1}\ H_{desired}$ as a pair of contralateral filters, (k) transforming the two pairs of ipsilateral filters and contralateral filters to a single pair of filters RES(1,1) and RES(2,2) to transform a lattice form to a shuffler form, (l) variable octave complex smoothing the pair of filters RES(1,1) and RES(2,2) to obtain smoothed filters sRES(111) and sRES(2,2) to preserve audio quality and spatial widening, and (m) transforming the pair of filters sRES(1,1) and sRES(2,2) back into lattice form for performing spatialization and preserving the audio quality.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
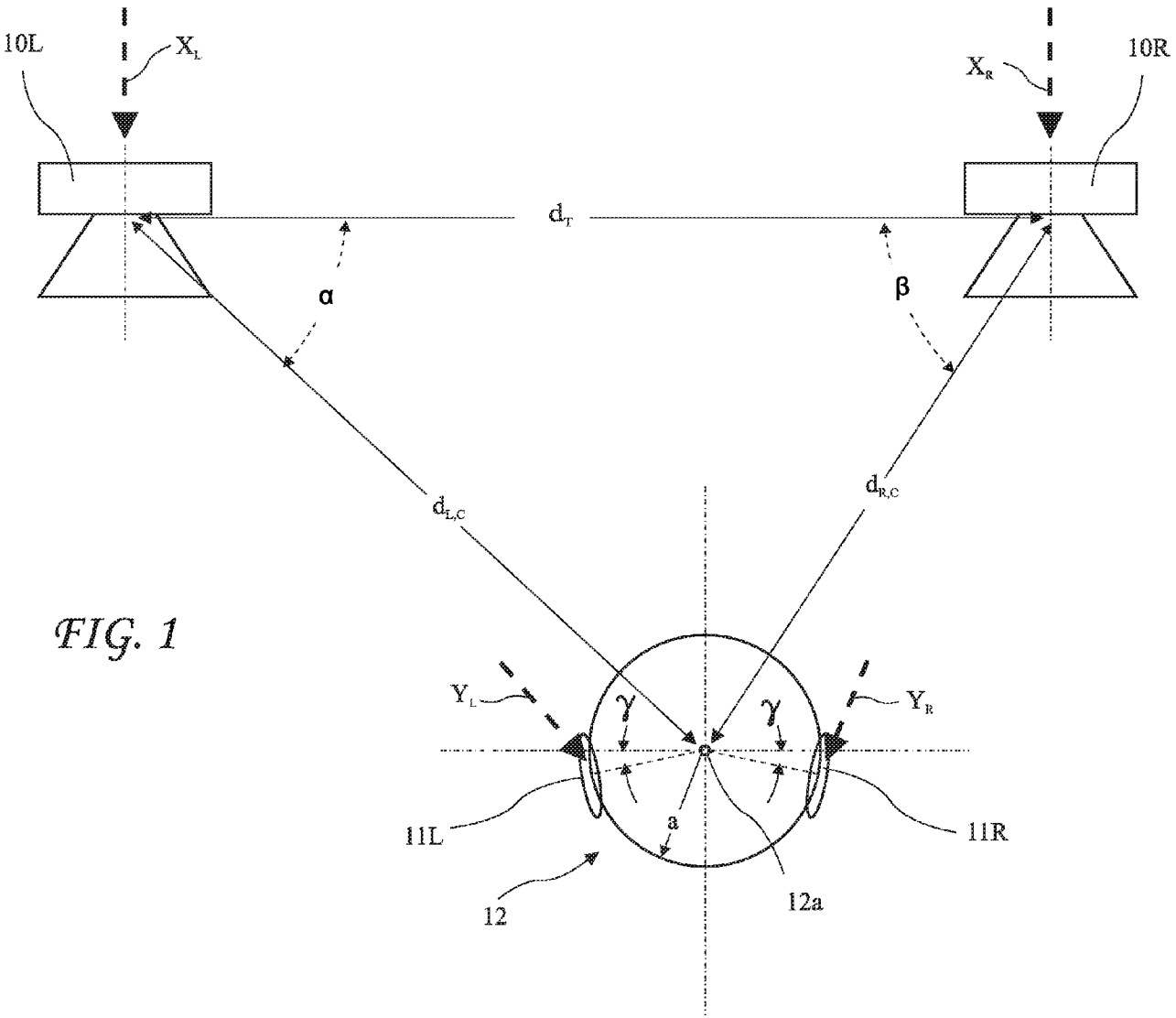
FIG. 1 shows an actual relative speaker to listener positioning and head shadow geometry.

Left and right speakers (or transduces) 10L and 10R and a listener 12 are shown in FIG. 1. The speakers 10L and 10R receive left and right channel signals $X_L$ and $X_R$ and have a speaker spacing $d_T$. Speaker response measurements may be obtained at a listener position 12*a* centered on the listener head 12 through two channels $\bar{h}_{L,C}$ and $\bar{h}_{R,C}$. Signals $Y_L$ and $Y_R$ at listener ear positions 11L and 11R are determined based on direct sound based binaural response modeling because localization is governed primarily through direct sound. The distances $d_{L,C}$ and $d_{R,C}$ from left speaker 10L and from the right speaker 10R respectively to a microphone centered at the listener position 12*a*, may be obtained from existing technique (for example, a sample in the first peak in the responses $\bar{h}_{L,C}$ and $\bar{h}_{R,C}$) or setting the distances to nominal values. Speaker angles α and β (where a 90 degree speaker angle is directly in front of the listener) may be computed as:

$$\alpha = \cos^{-1}\left(\frac{d_{L,C}^2 + d_T^2 + d_{R,C}^2}{2d_{L,C}d_T}\right)$$

$$\beta = \cos^{-1}\left(\frac{d_{R,C}^2 + d_T^2 + d_{L,C}^2}{2d_{R,C}d_T}\right)$$

The signals $Y_L$ and $Y_R$ at each ear position 11L and 11R may be represented in terms of the propagation delays and the effects of head shadowing (diffraction or attenuation effects) relative to the responses $h_{L,C}=\delta_{L,C}$ and $h_{R,C}=\delta_{R,C}$ (acoustic direct path propagation responses) at the listener position 12*a* from left and right speakers 10L and 10R respectively.

The listener 12 is assumed to have a head radius a of approximately nine centimeters, an ear offset γ of approximately ten degrees, and the system to have a sampling frequency of $f_s$. Four headshadowed responses result:

1) A headshadowed response $H_{\alpha+\gamma}^{L,L}(z)$ results from an observation point being the left ear position 11L for signals arriving from the left channel (i.e., the angle of the incident wave relative to the left ear position 11L is α+γ);

2) A headshadowed response $H_{\pi-\beta+\gamma}^{R,L}(z)$ results from an observation point being the left ear position 11L for signals arriving from the right channel (i.e., the angle of the incident wave relative to the left ear position 11L is π−β+γ);

3) A headshadowed response $H_{\pi-\alpha+\gamma}^{L,R}(z)$ results from an observation point being the right ear position 11R for signals arriving from the left channel (i.e., the angle of the incident wave relative to the right ear position 11R is π−α+γ); and 4) A headshadowed response $H_{\beta+\gamma}^{R,R}(z)$ results from an observation point being the right ear position 11R for signals arriving from the right channel (i.e., the angle of the incident wave relative to the right ear position 11R is β+γ).

The signals at each ear position 11L and 11R may then be calculated as a function of the headshadowed response as:

$$Y_L(z) = z^{\lfloor \psi_{L,L} \rfloor} H_{L,C}(z) | H_{\alpha+\gamma}^{L,L}(z) | X_L(z) + z^{\lfloor \psi_{R,L} \rfloor} H_{R,C}(z) | H_{\pi-\beta+\gamma}^{L,R}(z) | X_R(z)$$

$$Y_R(z) = z^{\lfloor \psi_{L,R} \rfloor} H_{L,C}(z) | H_{\pi-\alpha+\gamma}^{L,R}(z) | X_L(z) + z^{\lfloor \psi_{R,R} \rfloor} H_{R,C}(z) | H_{\beta+\gamma}^{R,R}(z) | X_R(z)$$

$$H_{L,C} = H_{R,C} = 1$$

where:

$$\psi_{L,L} = \begin{cases} \dfrac{a\cos(\alpha+\gamma)f_s}{c} & 0 < \alpha \le \dfrac{\pi}{2} - \gamma \\ \dfrac{-a\cos\left(\alpha - \dfrac{\pi}{2} + \gamma\right)f_s}{c} & \dfrac{\pi}{2} - \gamma < \alpha \le \dfrac{\pi}{2} \end{cases}$$

$$\psi_{R,R} = \begin{cases} \dfrac{a\cos(\beta+\gamma)f_s}{c} & 0 < \beta \le \dfrac{\pi}{2} - \gamma \\ \dfrac{-a\cos\left(\beta - \dfrac{\pi}{2} + \gamma\right)f_s}{c} & \dfrac{\pi}{2} - \gamma < \beta \le \dfrac{\pi}{2} \end{cases}$$

$$\psi_{R,L} = \begin{cases} \dfrac{-a\cos\left(\dfrac{\pi}{2} - \beta + \gamma\right)f_s}{c} & 0 < \beta \le \dfrac{\pi}{2} - \gamma \\ \dfrac{-a\cos\left(\dfrac{\pi}{2} - \beta + \gamma\right)f_s}{c} & \dfrac{\pi}{2} - \gamma < \beta \le \dfrac{\pi}{2} \end{cases}$$

and, $$\psi_{L,R} = \begin{cases} \dfrac{-a\cos\left(\dfrac{\pi}{2} - \alpha + \gamma\right)f_s}{c} & 0 < \alpha \le \dfrac{\pi}{2} - \gamma \\ \dfrac{-a\cos\left(\dfrac{\pi}{2} - \alpha + \gamma\right)f_s}{c} & \dfrac{\pi}{2} - \gamma < \alpha \le \dfrac{\pi}{2} \end{cases}$$

where $\psi_{X,Y}$ is the actual inter-aural delay between speaker X and ear Y, a is head radius, fs is sample frequency, and c is sound speed. $H_{L,C}$ and $H_{R,C}$ are speaker to center of head transfer function matrices and are assumed to be unity here.

Figure 2:
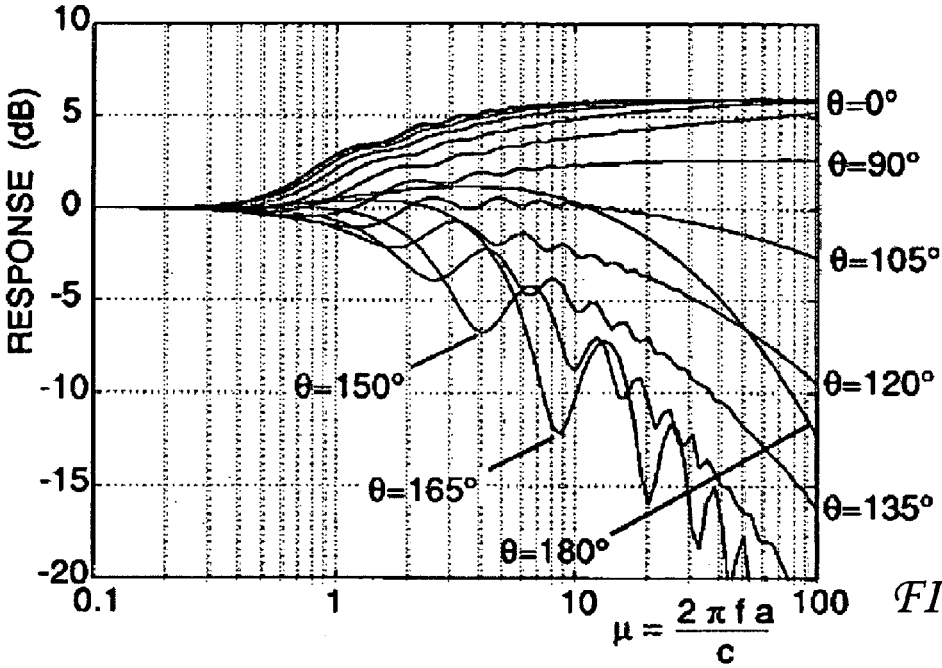
FIG. 2 shows head shadowing as a function of incidence angle.

The headshadowed models used are range independent. Accuracy may potentially be improved by multiplying by a distance or (room-dependent factor such as D/R) with $H_\theta(\omega)$ as shown in FIG. 2.

Figure 3:
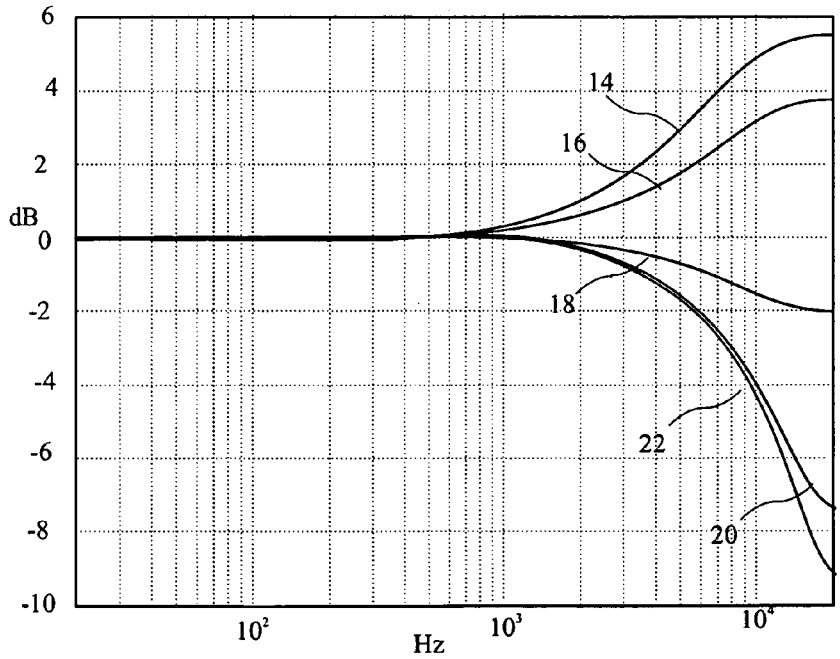
FIG. 3 shows a head shadow model.

The headshadowed model $H_\theta(\omega)$ may be approximated by a single pole filter $\hat{H}_\theta(\omega)$ shown in FIG. 3 for θ=0 degree (curve 14), θ=45 degree (curve 16), θ=90 degree (curve 18), θ=120 degree (curve 28), and θ=150 degree (curve 22), applied for f>1.5 kHz:

$$\hat{H}_\theta(\omega) = \frac{1 + \frac{j\tau_\theta\omega}{2\omega_0}}{1 + \frac{j\omega}{2\omega_0}}$$

$$\tau_\theta = \left(1 + \frac{\tau_{min}}{2}\right) + \left(1 + \frac{\tau_{min}}{2}\right)\cos\left(\frac{\theta}{\theta_{min}}180\right)$$

$$\tau_{min} = 0.1$$

$$\theta_{min} = 150$$

The signals $Y_L$ and $Y_R$ at each ear may then be represented in matrix form as:

$$\begin{bmatrix} Y_L \\ Y_R \end{bmatrix} = H\begin{bmatrix} X_L \\ X_R \end{bmatrix}$$

where the actual speaker to listener matrix transfer function H, including both inter-aural delays and headshadow responses, is:

$$H = \begin{bmatrix} z^{\psi L,L}\hat{H}^{L,L}_{\alpha+\gamma}(z) & z^{\psi R,L}\hat{H}^{R,L}_{\pi-\beta+\gamma}(z) \\ z^{\psi L,R}\hat{H}^{L,R}_{\pi-\alpha+\gamma}(z) & z^{\psi R,R}\hat{H}^{R,R}_{\beta+\gamma}(z) \end{bmatrix}$$

where the headshadow models $\hat{H}_\theta(\omega)$ may be minimum phase.

Additionally, an equalization filter matrix G(z) may be designed to counteract the effects of "regular" stereo perception using a joint minimum-phase approach disclosed in "An Alternative Design for Multichannel and Multiple Listener Room Equalization" S. Bharitkar, Proc. 2004 38$^{th}$ IEEE Asilomar Conference on Signal, Systems, and Computers, Pacific Grove, Calif., November 2004 to minimize artifacts:

$$\begin{bmatrix} Y_L \\ Y_R \end{bmatrix} = HG\begin{bmatrix} X_L \\ X_R \end{bmatrix}$$

and when G(z) is formed as $H^{-1}(z)$:

$$\begin{bmatrix} Y_L \\ Y_R \end{bmatrix} = \begin{bmatrix} X_L \\ X_R \end{bmatrix}$$

Figure 4:
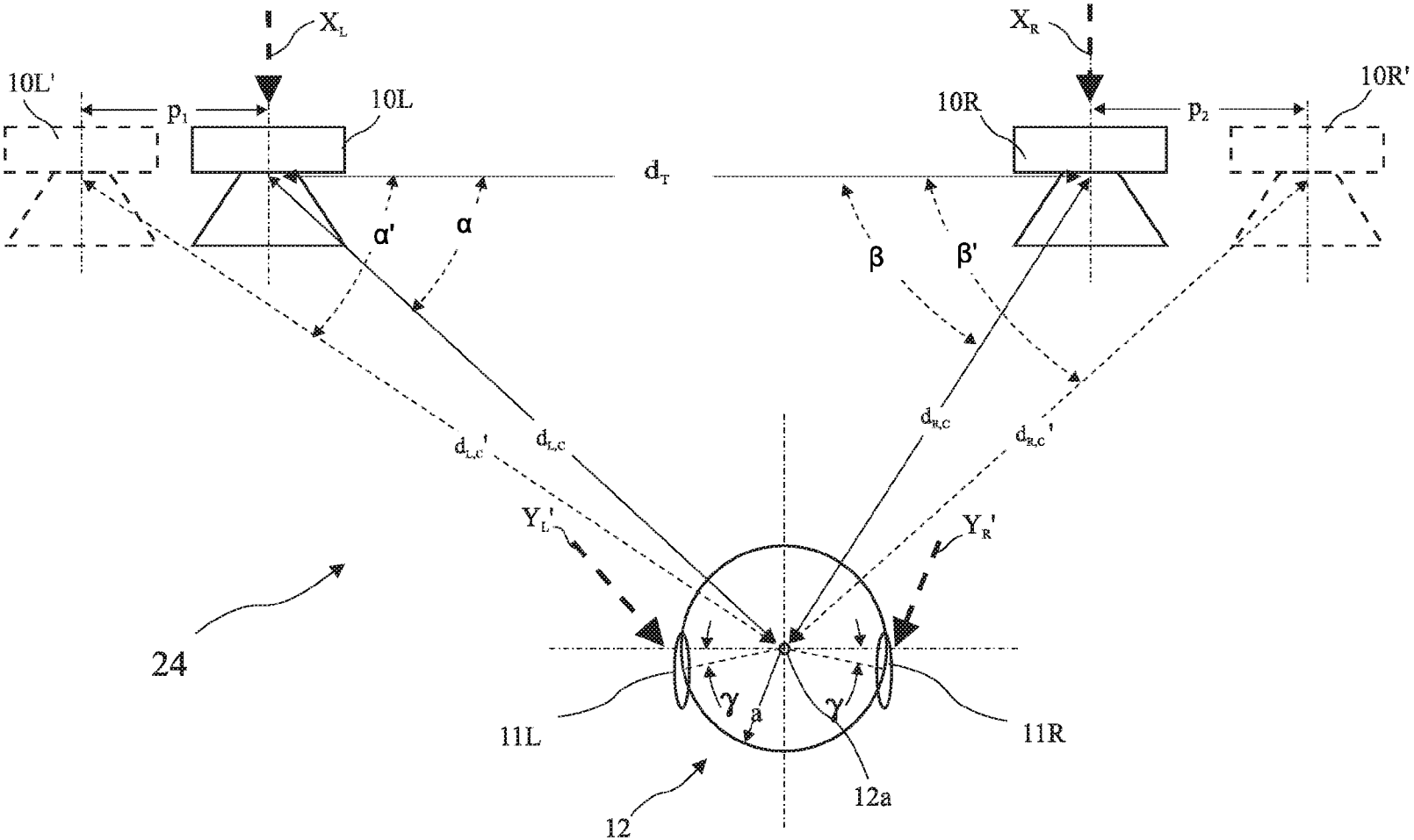
FIG. 4 shows a desired relative speaker to listener positioning for creating the impression of a widened and centered sound stage and an immersive listening experience according to the present invention.

A wide stereo synthesis visualization 24 according to the present invention is shown in FIG. 4. A left synthesized (or virtual) speaker 10L' is shown displaced a distance $p_1$ to the left of the speaker 10L, and a right synthesized (or virtual) speaker 10R' is shown displaced a distance $p_2$ to the right of the speaker 10L. Given $p_1$ and/or $P_2$, the distances $d_{L,C}'$ and $d_{R,C}'$ from the synthesized speakers to the microphone position are computed as:

$$d_{L,C}' = \sqrt{(p_1 + d_{L,C}\cos\alpha)^2 + (d_{L,C}\sin\alpha)^2}$$

$$d_{R,C}' = \sqrt{(p_2 + d_{R,C}\cos\beta)^2 + (d_{L,C}\sin\alpha)^2}$$

Virtual speaker angles α' and β' are computed:

$$\tan\alpha' = \frac{d_{L,C}\sin\alpha}{p_1 + d_{L,C}\cos\alpha}$$

and $$\tan\beta' = \frac{d_{L,C}\sin\alpha}{p_2 + d_{R,C}\cos\beta}$$

It is generally (but not necessarily) desired that the listener 12 perceives themself to be centered on the speakers 10L' and 10R'. In order to achieve the centered perception, the virtual speaker angles α' and β' should be perceived as being approximately equal, which is equivalent to:

$$p_1 + d_{L,C}\cos\alpha = p_2 + d_{R,C}\cos\beta$$

The desired left and right signals $Y_L'$ and $Y_R'$ at the listener ear positions 11L and 11R in matrix representation are:

$$\begin{bmatrix} Y_L \\ Y_R \end{bmatrix} = H_{desired}\begin{bmatrix} X_L \\ X_R \end{bmatrix}$$

where a speaker to listener matrix transfer function $H_{desired}$ is determined from the virtual inter-aural delays $\Delta_{X,Y}$ and the virtual headshadow responses:

$$H_{desired} = \begin{bmatrix} z^{\Delta L,L}\left|\hat{H}^{L,L}_{\alpha'+\gamma}(z)\right| & z^{\Delta R,L}\left|\hat{H}^{R,L}_{\pi-\beta'+\gamma}(z)\right| \\ z^{\Delta L,R}\left|\hat{H}^{L,R}_{\pi-\alpha'+\gamma}(z)\right| & z^{\Delta R,R}\left|\hat{H}^{R,R}_{\beta'+\gamma}(z)\right| \end{bmatrix}$$

Virtual inter-aural delays $\Delta_{L,L}$, $\Delta_{R,R}$, $\Delta_{L,R}$, and $\Delta_{R,L}$ based in the positions of the virtual speakers 10L' and 10R' and incorporated in left and right channels $\bar{h}_{L,C}$ and $\bar{h}_{R,C}$, are:

$$\Delta_{L,L} = \left\lfloor \frac{(-d_{L,C'} + \delta_{L,L})f_s}{c} \right\rfloor$$

$$\Delta_{R,R} = \left\lfloor \frac{(-d_{R,C'} + \delta_{R,R})f_s}{c} \right\rfloor$$

where, $$\delta_{L,L} = \begin{cases} a\cos(\alpha' + \gamma) & 0 < \alpha' \le \frac{\pi}{2} - \gamma \\ -a\cos\left(\alpha' - \frac{\pi}{2} + \gamma\right) & \frac{\pi}{2} - \gamma < \alpha' \le \frac{\pi}{2} \end{cases}$$

$$\delta_{R,R} = \begin{cases} a\cos(\beta' + \gamma) & 0 < \beta' \le \frac{\pi}{2} - \gamma \\ -a\cos\left(\beta' - \frac{\pi}{2} + \gamma\right) & \frac{\pi}{2} - \gamma < \beta' \le \frac{\pi}{2} \end{cases}$$

and $$\Delta_{R,L} = \left\lfloor \frac{(-d_{R,C'} + \delta_{R,L})f_s}{c} \right\rfloor$$

$$\Delta_{L,R} = \left\lfloor \frac{(-d_{L,C'} + \delta_{L,R})f_s}{c} \right\rfloor$$

where, $$\delta_{RL} = \begin{cases} -a\left(\frac{\pi}{2} - \beta' + \gamma\right) & 0 < \beta' \le \frac{\pi}{2} - \gamma \\ -a\left(\frac{\pi}{2} - \beta' + \gamma\right) & \frac{\pi}{2} - \gamma < \beta' \le \frac{\pi}{2} \end{cases}$$

-continued $$\delta_{L,R} = \begin{cases} -a\left(\frac{\pi}{2} - \alpha' + \gamma\right) & 0 < \alpha' \le \frac{\pi}{2} - \gamma \\ -a\left(\frac{\pi}{2} - \alpha' + \gamma\right) & \frac{\pi}{2} - \gamma < \alpha' \le \frac{\pi}{2} \end{cases}$$

and where the virtual inter-aural delays $\Delta_{X,Y}$ are in units of samples.

Figure 5:
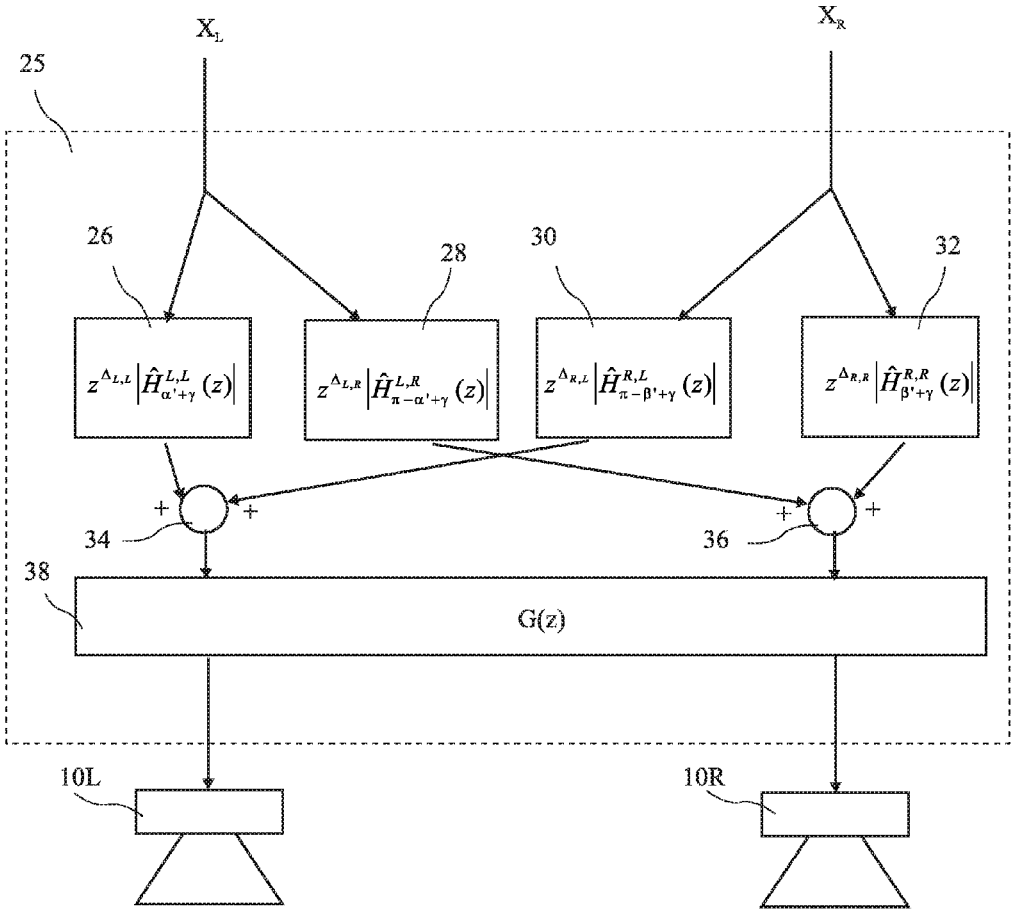
FIG. 5 is a wide synthesis stereo filter according to the present invention.

A wide synthesis stereo filter 25 according to the present invention and corresponding to the visualization of FIG. 4 is shown in FIG. 5. The filters 26, 28, 30, and 32 represent the elements of $H_{desired}$ and serve to create the desired wide stereo perception. The equalization filter G(z) 38 receives the summed outputs of the filters 26 and 30, and 38 and 32, summed at 34 and 36 respectively and serves to reduce or eliminate the effects of regular stereo perception.

Surround synthesis may be obtained by substituting -γ for γ to obtained:

$$\Delta_{L,L} = \left\lfloor \frac{(-d_{L,C'} + \delta_{L,L})f_s}{c} \right\rfloor$$

$$\Delta_{R,R} = \left\lfloor \frac{(-d_{R,C'} + \delta_{R,R})f_s}{c} \right\rfloor$$

where, $$\delta_{L,L} = a\cos(\alpha' - \gamma) \quad 0 < \alpha' \le \frac{\pi}{2}$$

$$\delta_{R,R} = a\cos(\beta' - \gamma) \quad 0 < \beta' \le \frac{\pi}{2}$$

and $$\Delta_{R,L} = \left\lfloor \frac{(-d_{R,C'} + \delta_{R,L})f_s}{c} \right\rfloor$$

$$\Delta_{L,R} = \left\lfloor \frac{(-d_{L,C'} + \delta_{L,R})f_s}{c} \right\rfloor$$

where, $$\delta_{RL} = -a\left(\frac{\pi}{2} - \beta' - \gamma\right) \quad 0 < \beta' \le \frac{\pi}{2}$$

$$\delta_{L,R} = -a\left(\frac{\pi}{2} - \alpha' - \gamma\right) \quad 0 < \alpha' \le \frac{\pi}{2}$$

Figure 6:
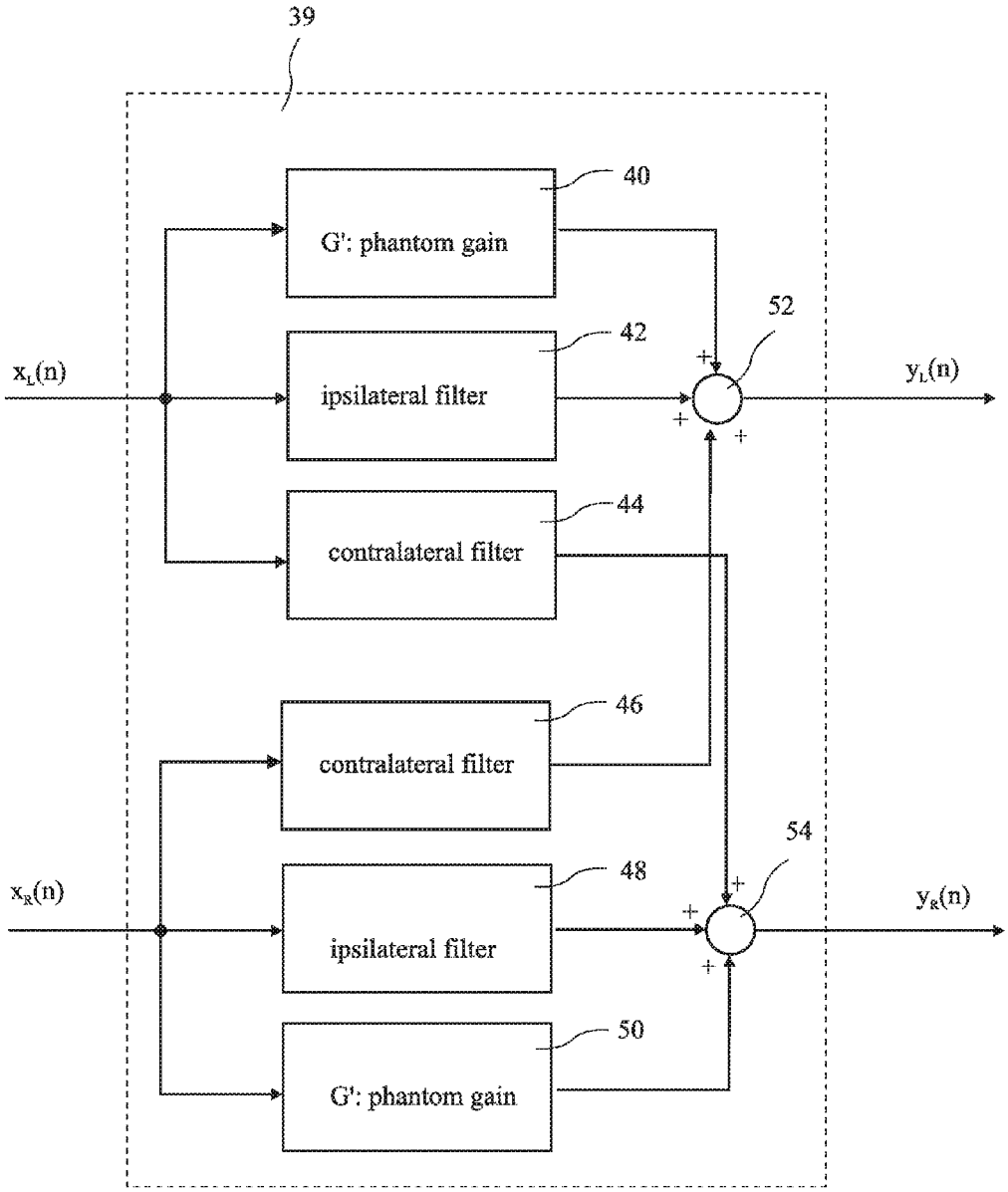
FIG. 6 is a spatial equalization filter including widening and a phantom center channel shown in a lattice structure according to the present invention.

A phantom center channel filter 39 according to the present invention providing widening along with generating a phantom center is shown in a lattice structure in FIG. 6. A pair of ipsilateral filters 42 and 48 and a pair of contralateral filters 44 and 46 may be determined from the 2×2 matrix $G^*H_{desired}$, where G includes $H^{-1}$. G and $H_{desired}$ are computed as described above. In the general case, the pair of ipsilateral filters 42 and 48 are the diagonal terms of $G^*H_{desired}$, and the contralateral filters 44 and 46 are the off-diagonal terms of $G^*H_{desired}$. In special cases where the listener 12 is centered on the speakers 10L and 10R, the two diagonal terms are equal and the two off diagonal terms are equal so that the ipsilateral filters 42 and 48 may be obtained from the first row and first column of the frequency response matrix $G^*H_{desired}$ and the contralateral filters 44 and 46 may be obtained from the first row and second column of the frequency response matrix $G^*H_{desired}$. The matrix $G^*H_{desired}$ is computed at various frequency values and the inverse Fourier transform is taken to obtain the ipsilateral filters 42 and 48 and the contralateral filters 44 and 46 in the time domain.

The matrix $G^*H_{desired}$ is a 2×2 matrix for each frequency point. If there are 512 frequency points we obtain 512 matrices of 2×2 size. In the listener centered case, only the element in the first row and first column from each of the 512 2×2 matrices is taken to form a frequency response vector for the ipsilateral filters 42 and 48. The frequency response vector is inverse Fourier transformed to obtain the ipsilateral time domain filters 42 and 48. The process is repeated to obtain the contralateral filters 44 and 46 but selecting the element in the first row and second column. A second equalization filter G' 40, 50 provides the phantom center. The phantom center channel filter 39 may process either the inputs to a room equalizer or process the outputs of the room equalizer.

Figure 7:
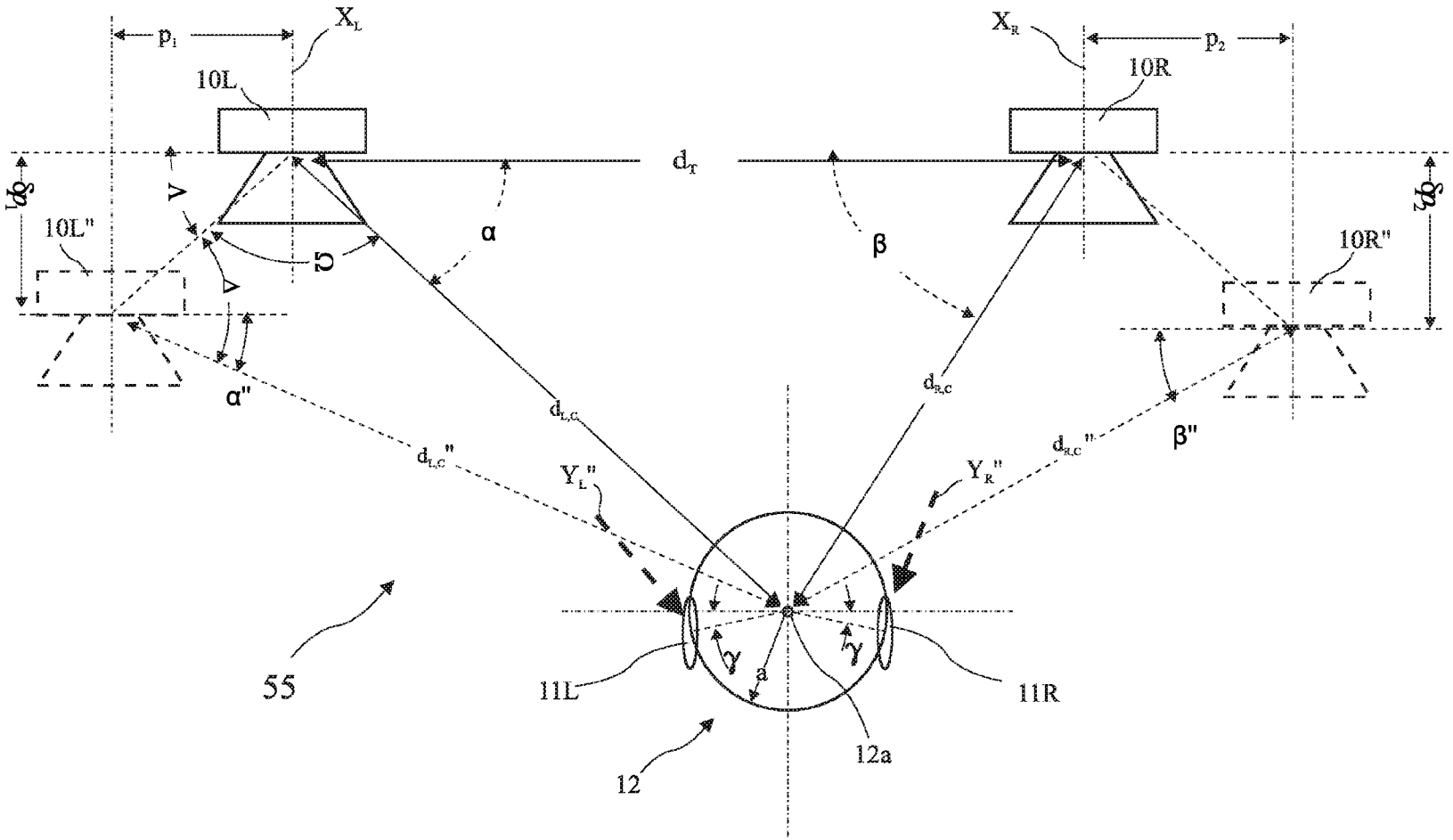
FIG. 7 shows a visualization of relative speaker to listener positioning for creating the impression of a widened and arcing according to the present invention.

The method of the present invention may further be expanded to provide a perception of arcing. An arced stereo synthesis visualization 55 according to the present invention is shown in FIG. 7. A desired relative speaker to listener positioning for creating the impression of a widened and arcing according to the present invention is provided by a second left synthesized (or virtual) speaker 10L" shown displaced a distance $p_1$ to the left and $\delta p_1$ ahead of the speaker 10L, and a second right synthesized (or virtual) speaker 10R" shown displaced a distance $p_2$ to the right and $\delta p_2$ ahead of the speaker 10L. The following equations result:

$$\Lambda = \tan^{-1}\left(\frac{\delta_{P1}}{p_1}\right)$$

$$z^2 = p_1^2 + \delta_{P1}$$

$$\Omega = \pi - \Lambda - \alpha$$

$$d_{LW,C}^2 = d_{L,C}^2 + z^2 - 2zd_{L,C}\cos\Omega$$

$$\Delta = \cos^{-1}\left(\frac{z^2 + d_{LW,C}^2 - d_{L,C}^2}{2zd_{LW,C}}\right)$$

$$\alpha' = \Delta - \Lambda$$

where these terms may be substituted into the above equations for computing the inter-aural delays $\Delta_{X,Y}$ obtain widening and arcing according to the present invention.

The methods of the present invention may further be expanded to include where:

the binaural modeled equalization matrix G(z) is lower order modeled with existing techniques;

simple delays and shadowing filters (one poll) are implemented;

the stereo-expansion system compensates for speaker room effects simultaneously;

multi-position and robustness is obtained with least-squares based binaural equalization filter matrix G(z), spatial derivatives/difference constraints etc.

speech—music discrimination for center channel synthesis with PC=$-d_T/2$ and/or integrating with $X_L+X_R$ approach;

potential to pre-integrated with PrevEQ by using head diffraction model engaged beyond 1.5 kHz (that is, intensity differences) with speaker only response;

using all pass filters with group delays $T_1^{f<1.5\ kHz}=c_1$ and $T_2^{f>1.5\ kHz}=c_2$ for $\Delta_{L,R}$ ($\Delta_{R,L}$);

torso modeling; and distance or room-based function multiplying head-diffraction model.

The lattice form can be transformed to the shuffler form (as in Bauck et al, "Prospects of Transaural Recording," Journal of Audio Eng. Soc., vol. 37 (1/2), January/February 1989). For example, assuming a 2×2 matrix X having elements S and A:

$$X = \begin{bmatrix} S & A \\ A & S \end{bmatrix}$$

where S is the ipsilateral transfer function and A is the contralateral function The inverse Y of X is:

$$Y = X^{-1} = \frac{1}{S^2 - A^2}\begin{bmatrix} S & -A \\ -A & S \end{bmatrix}$$

and Y can be factored using eigenvalue/eigenvector decomposition as:

$$Y = \begin{bmatrix} 1 & 1 \\ 1 & -1 \end{bmatrix}\begin{bmatrix} \frac{1}{2(S+A)} & 0 \\ 0 & \frac{1}{2(S-A)} \end{bmatrix}\begin{bmatrix} 1 & 1 \\ 1 & -1 \end{bmatrix}$$

Note, in this form there are only two filters (i.e., 1/(2(S+A)) and 1/(2(S−A)) located diagonally instead of four filters. The closer these are to a value unity, the net transfer function Y since Y=[1 0;0 1] becomes relatively lossless at all frequencies which implies no distortion or artifacts. In this case the output as Y=[2 0;0 2] which implies YL=2*XL and YR=2*XR (i.e., the left channel is transmitted to the output simply gain changed by a factor of 2 and the right channel is transmitted to the output gain changed by a factor of 2).

Incorporating this concept into the present system, the inverse $G=H^{\wedge(-1)}$ may be multiplied with $H_{desired}$ and factored into shuffler form as:

$$RES = G*H_{desired} = H^{\wedge(-1)}*H_{desired} = Y*H_{desired}$$

with $H_{desired}$ being represented as $H_{desired}$=[L M;M L] where L and M are the desired ipsilateral and contralateral transfer functions (i.e., including the inter-aural delays and headshadow responses). Thus the resulting filters in lattice form can be expressed as:

$$\begin{aligned} RES &= (1/(S\wedge(2) - A\wedge(2))[S - A; -A\ S][L\ M; M\ L] \\ &= (1/(S\wedge(2) - A\wedge(2))[SL - AM\ SM - AL; \\ &\quad SM - AL\ SL - AM] \end{aligned}$$

The above may be factored using eigen decomposition into:

$$\begin{aligned} RES &= [RES(1, 1)0; 0\ RES(2, 2)] \\ &= [1\ 1; 1 - 1][(L + M)/2 * (S + A)\ 0; \\ &\quad 0\ (L - M)/2 * (S - A)][1\ 1; 1 - 1] \end{aligned}$$

Figure 8:
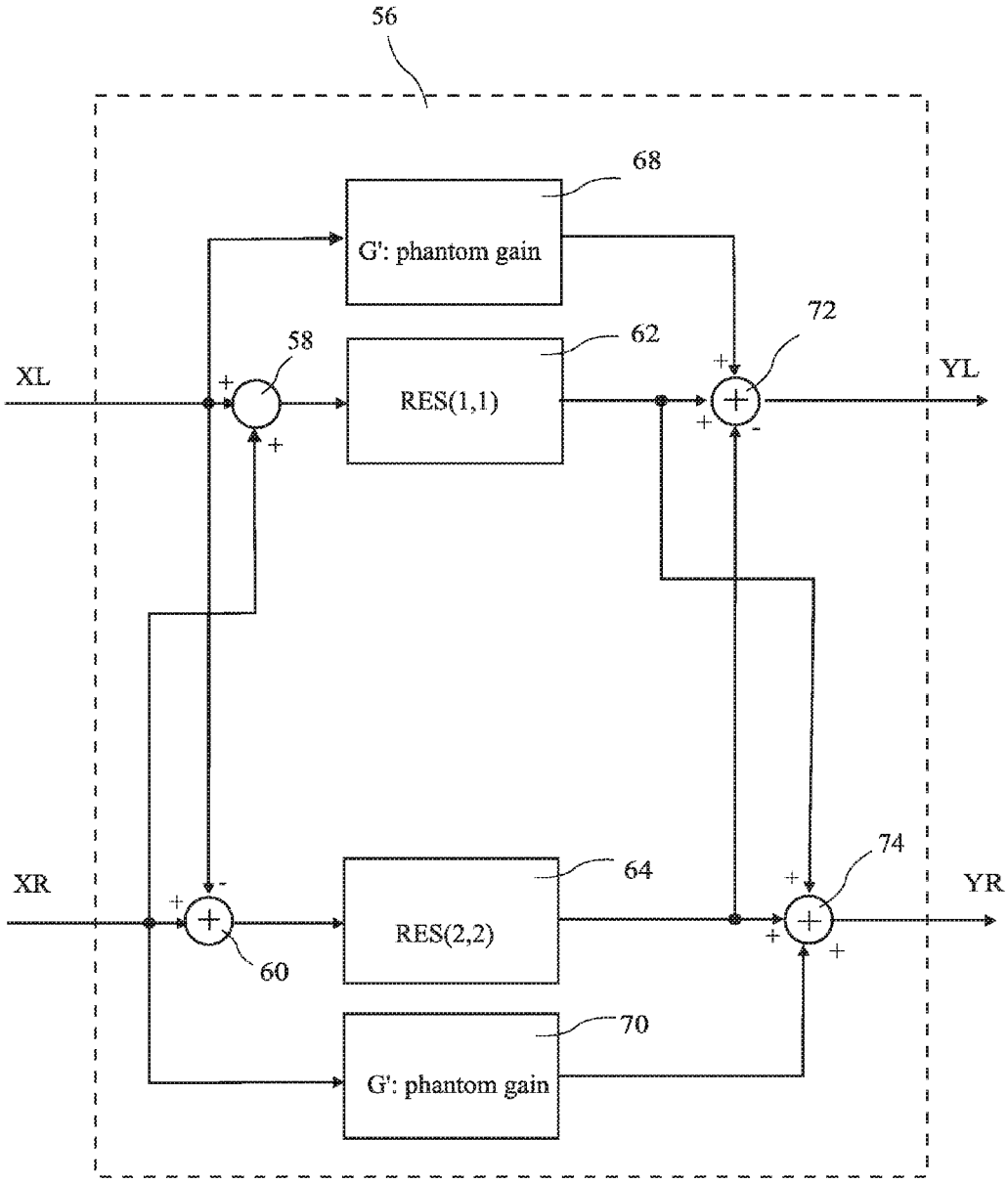
FIG. 8 shows a shuffler filter representation of the present invention.

The resulting shuffler filter is shown in FIG. 8 where the two filters RES(1,1) 62 and RES(2,2) 64, one in each channel, are transformed from the lattice structure of FIG. 6. The sum 58 of signals XL and XR is provided to RES(1,1) and the difference 60 of signal XR−XL is provided to RES(2,2) 64. The signal XL is provided to the phantom gain G' 68 and the signal XR is provided to the phantom gain G' 70. The difference 72 of the output of G' 68 plus RES(1,1) 62 minus RES(2,2) 64 is output as YL and the sum 74 of the output of G' 70 plus RES(1,1) 62 plus RES(2,2) 64 is output as YL.

Figure 9A:
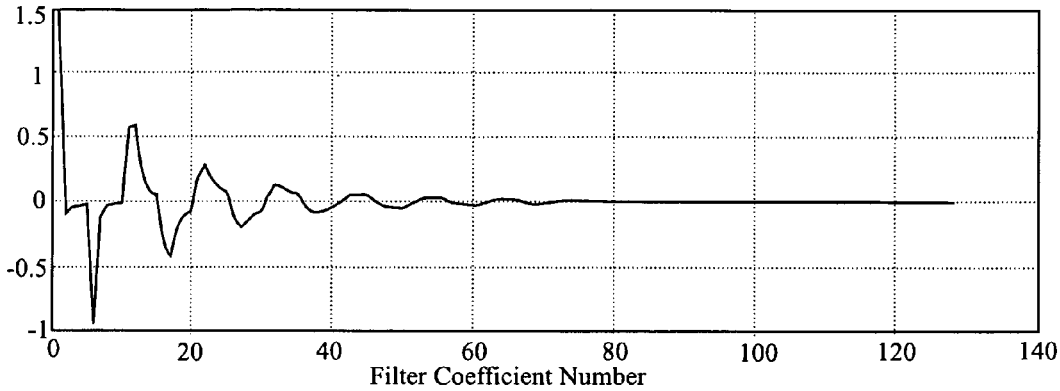
FIG. 9A shows unsmoothed filter coefficients for RES(1,1) according to the present invention.
Figure 9B:
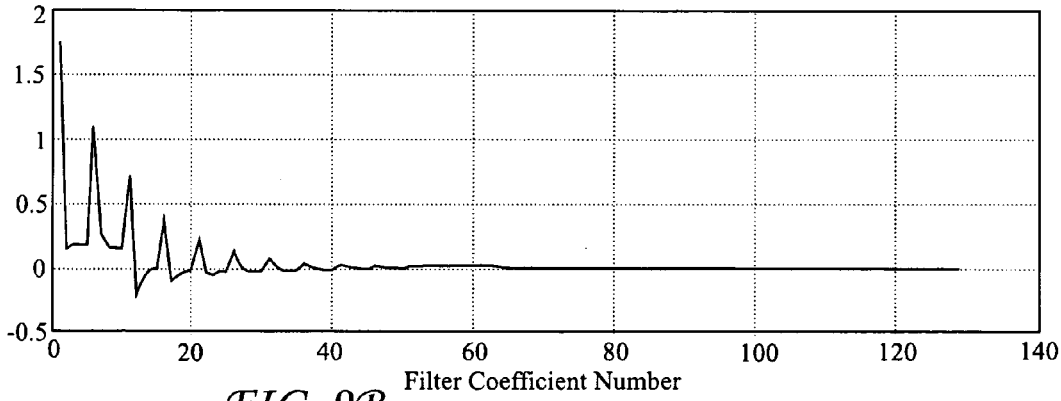
FIG. 9B shows unsmoothed filter coefficients for RES(2,2) according to the present invention.
Figure 10A:
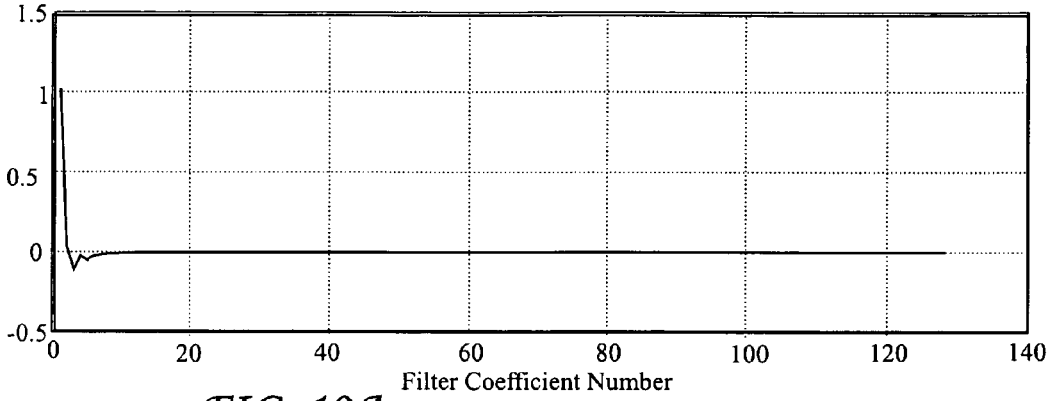
FIG. 10A shows smoothed filter coefficients for sRES(1,1) according to the present invention.
Figure 10B:
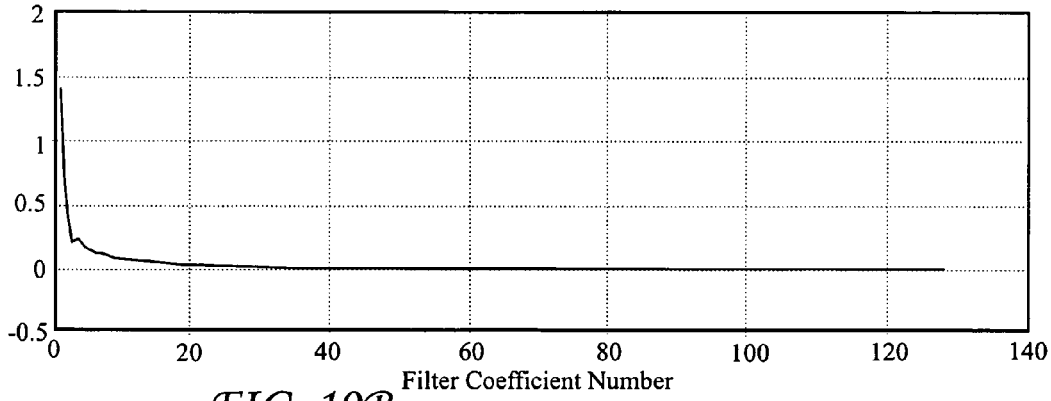
FIG. 10B shows smoothed filter coefficients for sRES(2,2) according to the present invention.

Examples of unsmoothed filters RES(1,1) and RES(2,2) are shown before smoothing in FIGS. 9A and 9B. Smoother filters sRES(1,1) and sRES(2,2) are shown after complex smoothed (joint magnitude and phase) using a variable-octave complex smoother to remove unwanted temporal (magnitude and phase) variations that result in artifacts in the reproduced sound quality in FIGS. 10A and 10B. In this example, the smoothing is 4 octave wide smoothing to remove unnecessary temporal variations so as to approximate a Kronecker delta function. This feature, in essence, provides a tradeoff between amount of spatialization and audio fidelity. The variable-octave complex smoothing allows high-resolution frequency smoothing in regions of the frequency response of the filter by retaining perceptual features in the frequency response of each of the filters which are dominant for accurate localization, while at the same time performing temporal smoothing to allow each filter to converge to a delta function such that RES matrix is close to [1 0;0 1] at each frequency bin for maintaining audio fidelity. The variable-octave complex-domain smoother is described in "Variable-Active Complex Smoothing for Loudspeaker-room Response Equalization" published in Proceedings of IEEE International Conference Consumer Electronics, Las Vegas Nev., January 2008, authored by S. Bharitkar, C. Kyriaskakis, and T. Holman.

For example, a complex-domain ⅓ octave full-band (0 Hz to Fs/2 where Fs=sampling frequency in Hz) smoothing may be performed, or 2-octaves wide full-band smoothing may be performed, or $1/12^{th}$-octave smoothing between 1 kHz and 10 kHz may be performed (as the headshadow functions of FIG. 2 show variations in this region) and 2-octave complex (joint magnitude and phase) smoothing may be performed in the other region (viz., [0 Hz, 1 kHz)U(10 kHz, Fs/2)). Subsequently, the smoothed filters sRES are transformed back into the lattice form of FIG. 6 by the following transformation (where sRES(x,x) is the corresponding smoothed filter of the shuffler form RES(x,x)).

The resulting filters are:

$$\begin{aligned} &= [1\ 1; 1 - 1][sRES(1, 1)\ 0; 0\ sRES(2, 2)][1\ 1; 1 - 1] \\ &= [sRES(1, 1) + sRES(2, 2)\ \ sRES(1, 1) - sRES(2, 2); \\ &\quad sRES(1, 1) - sRES(2, 2)\ \ sRES(1, 1) + sRES(2, 2)] \end{aligned}$$

Figure 11:
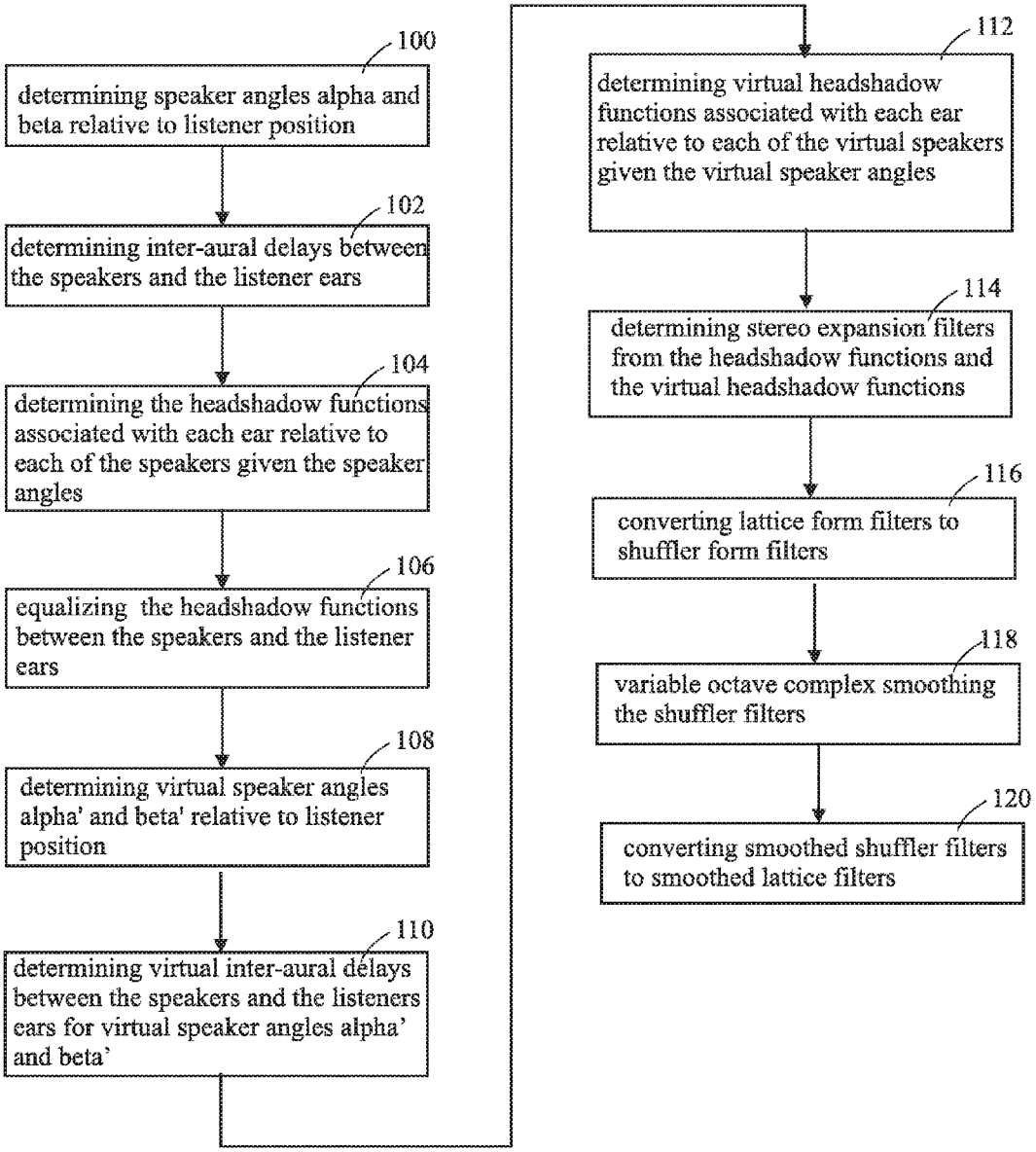
FIG. 11 describes a method according to the present invention.

A method for providing a stereo-widened sound in a stereo speaker system is described in FIG. 11. The method includes determining speaker angles alpha and beta relative to a listener position wherein said speaker angles are computed using stereo speaker spacing and listener position at step 100, determining inter-aural delays between the speakers and the listeners ears at step 102, determining the headshadow responses associated with each ear relative to each of the speakers given the speaker angles at step 104, equalizing the headshadow responses between the speakers and the listener ears at step 106, determining virtual speaker angles alpha' and beta' relative to listener position at step 108, determining virtual inter-aural delays between the speakers and the listeners ears for virtual speaker angles alpha' and beta' at step 110, determining virtual headshadow responses associated with each ear relative to each of the virtual speakers given the virtual speaker angles at step 112, determining stereo expansion filters from the headshadow responses and the virtual headshadow responses at step 114, converting lattice form filters to shuffler form filters at step 116, variable octave complex smoothing the shuffler filters at step 118, and converting smoothed shuffler filters to smoothed lattice filters for performing spatialization and preserving the audio quality.

While the invention herein disclosed has been described by means of specific embodiments and applications thereof, numerous modifications and variations could be made thereto by those skilled in the art without departing from the scope of the invention set forth in the claims.

We claim:

1. A method for providing a stereo-widened sound in a stereo speaker setup comprising:

(a) determining actual speaker angles alpha and beta relative to listener position wherein said speaker angles are computed using actual stereo speaker spacing and listener position;

(b) determining actual inter-aural delays between the speakers and the listener ears;

(c) determining the actual headshadow responses associated with each ear relative to each of the speakers given the speaker angles;

(d) determining an actual speaker to listener transfer function H using the actual inter-aural delays and the actual headshadow responses;

(f) determining virtual speaker angles alpha' and beta' relative to listener position wherein said virtual speaker angles are computed using a virtual stereo speaker spacing and listener position;

(g) determining virtual inter-aural delays between the virtual speakers and the listeners ears for virtual speaker angles alpha' and beta' relative to listener position;

(h) determining virtual headshadow responses associated with each ear relative to each of the virtual speakers given the virtual speaker angles and;

(i) determining a virtual speaker to listener transfer function $H_{desired}$ representing the transfer functions between the virtual speakers and the listener ears; and (j) computing two pairs of stereo expansion filters as a function of the actual speaker to listener transfer function H and the virtual speaker to listener transfer function $H_{desired}$;

and wherein the listener is centered on the actual speakers, and the method further including:

(k) transforming the two pairs of filters to a single pair of filters RES(1,1) and RES(2,2) to transform a lattice form to a shuffler form;

(l) variable octave complex smoothing the pair of filters RES(1,1) and RES(2,2) to obtain smoothed filters sRES (1,1) and sRES(2,2) to preserve audio quality and spatial widening; and (m) transforming the pair of filters sRES(1,1) and sRES(2, 2) back into lattice form for performing spatialization and preserving the audio quality.

2. The method of claim 1, wherein:

the actual speaker to listener transfer function H is a 2×2 matrix;

the virtual speaker to listener transfer function $H_{desired}$ is a 2×2 matrix; and computing two pairs of stereo expansion filters from the products of terms of the actual speaker to listener transfer function H and the virtual speaker to listener transfer function $H_{desired}$ comprises selecting on-diagonal terms of $H^{-1}$ $H_{desired}$ as a first pair of filters and selecting off-diagonal terms of $H^{-1}$ $H_{desired}$ as a second pair of filters.

3. The method of claim 2, wherein the listener is centered on the speakers, and further including:

using eigenvalue/eigenvector decomposition to transform the two pairs of filters to a single pair of filters RES(1,1) and RES(2,2) to transform a lattice form to a shuffler form;

smoothing the pair of filters RES(1,1) and RES(2,2) to obtain smoothed filters sRES(1,1) and sRES(2,2) to preserve audio quality and spatial widening; and transforming the pair of filters sRES(1,1) and sRES(2,2) back into lattice form for performing spatialization and preserving the audio quality.

4. The method of claim 2, wherein computing two pairs of stereo expansion filters from the products of terms of the actual speaker to listener transfer function H and the virtual speaker to listener transfer function $H_{desired}$ comprises selecting on-diagonal elements of $H^{-1}$ $H_{desired}$ as a pair of ipsilateral filters and selecting off-diagonal elements of $H^{-1}$ $H_{desired}$ as a pair of contralateral filters.

5. The method of claim 1, wherein the virtual speakers comprise a left virtual speaker offset to the left of a left actual speaker and a right virtual speaker offset to the right of a right actual speaker to create a widened sound perception for the listener.

6. The method of claim 5, wherein the virtual speakers comprise a left virtual speaker offset to the left and ahead of a left actual speaker and a right virtual speaker offset to the right and ahead of a right actual speaker to create a widened and arced sound perception for the listener.

7. The method of claim 1, further including computing a phantom gain to create a perception of a center speaker.

8. A method for providing a stereo-widened sound in a stereo speaker setup comprising:

(a) determining actual speaker angles alpha and beta relative to listener position centered on the actual speakers wherein said speaker angles are computed using actual stereo speaker spacing and listener position;

(b) determining actual inter-aural delays between the speakers and the listener ears;

(c) determining the actual headshadow responses associated with each ear relative to each of the speakers given the speaker angles;

(d) determining an actual speaker to listener 2×2matrix transfer function H using the actual inter-aural delays and the actual headshadow responses;

(f) determining virtual speaker angles alpha' and beta' relative to listener position wherein said virtual speaker angles are computed using a virtual stereo speaker spacing and listener position;

(g) determining virtual inter-aural delays between the virtual speakers and the listeners ears for virtual speaker angles alpha' and beta' relative to listener position;

(h) determining virtual headshadow responses associated with each ear relative to each of the virtual speakers given the virtual speaker angles and;

(i) determining a virtual speaker to listener 2×2matrix transfer function $H_{desired}$ representing the transfer functions between the virtual speakers and the listener ears;

(j) selecting on-diagonal elements of $H^{-1}$ $H_{desired}$ as a pair of ipsilateral filters and selecting off-diagonal elements of $H^{-1}$ $H_{desired}$ as a pair of contralateral filters;

(k) transforming the two pairs of ipsilateral filters and contralateral filters to a single pair of filters RES(1,1) and RES(2,2) to transform a lattice form to a shuffler form;

(l) variable octave complex smoothing the pair of filters RES(1,1) and RES(2,2) to obtain smoothed filters sRES (1,1) and sRES(2,2) to preserve audio quality and spatial widening; and (m) transforming the pair of filters sRES(1,1) and sRES(2, 2) back into lattice form for performing spatialization and preserving the audio quality.

9. A method for providing a stereo-widened sound in a stereo speaker setup comprising:

(a) determining actual speaker angles alpha and beta relative to listener position wherein said speaker angles are computed using actual stereo speaker spacing and listener position;

(b) determining actual inter-aural delays between the speakers and the listener ears;

(c) determining the actual headshadow responses associated with each ear relative to each of the speakers given the speaker angles;

(d) determining an actual speaker to listener transfer function H using the actual inter-aural delays and the actual headshadow responses;

(f) determining virtual speaker angles alpha' and beta' relative to listener position wherein said virtual speaker angles are computed using a virtual stereo speaker spacing and listener position;

(g) determining virtual inter-aural delays between the virtual speakers and the listeners ears for virtual speaker angles alpha' and beta' relative to listener position;

(h) determining virtual headshadow responses associated with each ear relative to each of the virtual speakers given the virtual speaker angles and;

(i) determining a virtual speaker to listener transfer function $H_{desired}$ representing the transfer functions between the virtual speakers and the listener ears; and (j) computing two pairs of stereo expansion filters as a function of the actual speaker to listener transfer function H and the virtual speaker to listener transfer function $H_{desired}$;

wherein the listener is centered on the speakers, and further including:

using eigenvalue/eigenvector decomposition to transform the two pairs of filters to a single pair of filter RES(1,1) and RES(2,2) to transform a lattice form to a shuffler form;

smoothing the pair of filters RES(1,1) and RES(2,2) to obtain smoothed filters sRES(1,1) and sRES(2,2) to preserve audio quality and spatial widening; and transforming the pair of filters sRES(1,1) and sRES(2,2) back into lattice form for performing spatialization and preserving audio quality.

* * * * *